US009445652B1

(12) United States Patent
Yousef

(10) Patent No.: US 9,445,652 B1
(45) Date of Patent: Sep. 20, 2016

(54) DEVICE FOR ROTATING JEWELRY SETTING MOUNT

(71) Applicant: Elias Yousef, Los Angeles, CA (US)

(72) Inventor: Elias Yousef, Los Angeles, CA (US)

( * ) Notice: Subject to any disclaimer, the term of this patent is extended or adjusted under 35 U.S.C. 154(b) by 0 days.

(21) Appl. No.: 14/800,445

(22) Filed: Jul. 15, 2015

(51) Int. Cl.
*A44C 9/00* (2006.01)
*A44C 17/02* (2006.01)

(52) U.S. Cl.
CPC ..... *A44C 17/0258* (2013.01); *A44C 9/00* (2013.01)

(58) Field of Classification Search
CPC ..... A44C 17/0258; A44C 9/00
USPC ..... 63/15–15.1, 26, 29.1, 30–31
See application file for complete search history.

(56) References Cited

U.S. PATENT DOCUMENTS

2012/0090356 A1* 4/2012 Liberman ..... A44C 9/003 63/3

FOREIGN PATENT DOCUMENTS

GB 790517 A * 2/1958 ..... A44C 17/0258

* cited by examiner

*Primary Examiner* — Abigail Morrell
(74) *Attorney, Agent, or Firm* — Irving Keschner

(57) ABSTRACT

A mechanism for manually rotating decorative items, such as a gemstone, on an item of jewelry. The mechanism includes a circular ring gear that engages gears formed on a manually rotated crown member and on the mounting securing for the decorative items.

5 Claims, 3 Drawing Sheets

DEVICE FOR ROTATING JEWELRY SETTING MOUNT

BACKGROUND OF THE INVENTION

1. Field of the Invention

The present invention relates to a simplified mechanism for rotating a mounting having one, or multiple, decorative items, including a gemstone, secured therein.

2. Description of the Prior Art

U.S. Pat. No. 7,536,874 to Ray et al discloses a jewelry item with a substantially hollow housing having a bezel and gemstone rotatably mounted on the upper end thereof. Received within the housing is a motor that operates a plurality of interrelated, contiguous gears to rotate the bezel. The gear ratios are such that the bezel will rotate at a predetermined, selected speed to achieve a desired aesthetic affect. A switch having a battery mounted thereon is hingedly attached to a side edge of the housing for activating the motor.

Although the Ray et al provides a device for rotating a gemstone in order to provide a pleasing aesthetic effect, the device is complex and requires a significant number of components, including three gears and a motor.

What is desired is to provide a jewelry item having at least one decorative item, including a gemstone, secured in a mounting that has a relative simple mechanism for manually rotating the mounting.

SUMMARY OF THE INVENTION

The present invention provides a jewelry item having a gemstone that is manually rotatable to provide a discrete aesthetic appearance.

The device for rotating the decorative item comprises a hollow, cylindrical frame member having an exterior surface, a circular, multi-tooth gear ring mounted to the exterior surface of the frame member, a stem, or crown, having a gear mounted on its shaft which is positioned to engage the teeth on the circular gear, a rotatable mount having a shaft extending there through, one end of the shaft supporting the mount, the other shaft end coupled to a drive gear which, in turn, is positioned to engage the teeth on the circular gear.

The decorative item is rotated by the user turning the crown, in either a clockwise or counterclockwise direction, the gear mounted thereto rotating in a manner such that the gear teeth thereon engage the gear teeth on the circular gear causing the circular gear to rotate. Since the teeth on the circular gear already in engagement with the teeth on the bezel gear, the mount is used to rotate which, in turn, enabling the decorative items coupled to the mount also to rotate.

The present invention thus provides a relatively simple and inexpensive mechanism for rotating decorative items positioned on a jewelry item.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1:
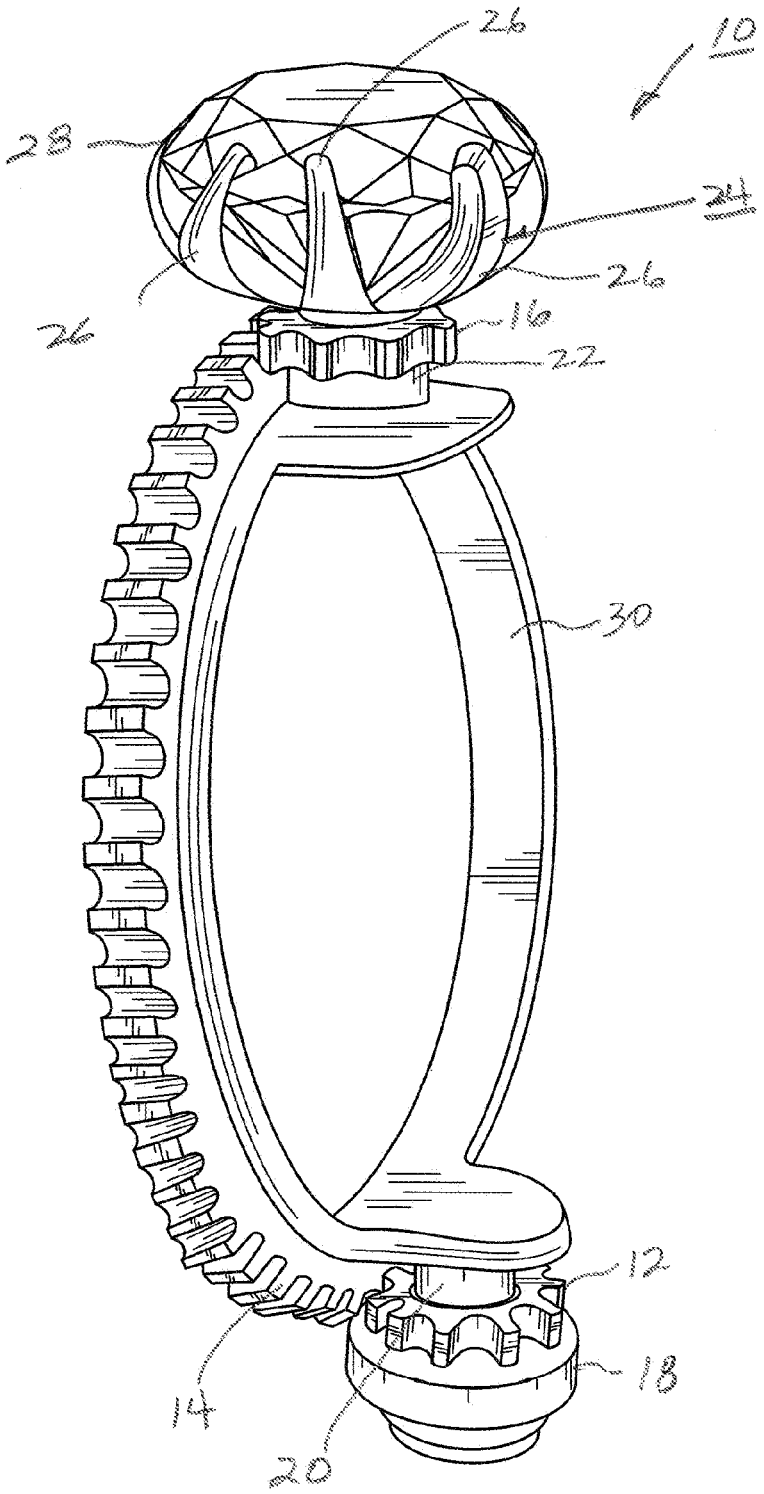
FIG. 1 is a perspective view illustrating the ring rotating mechanism of the present invention.
Figure 2:
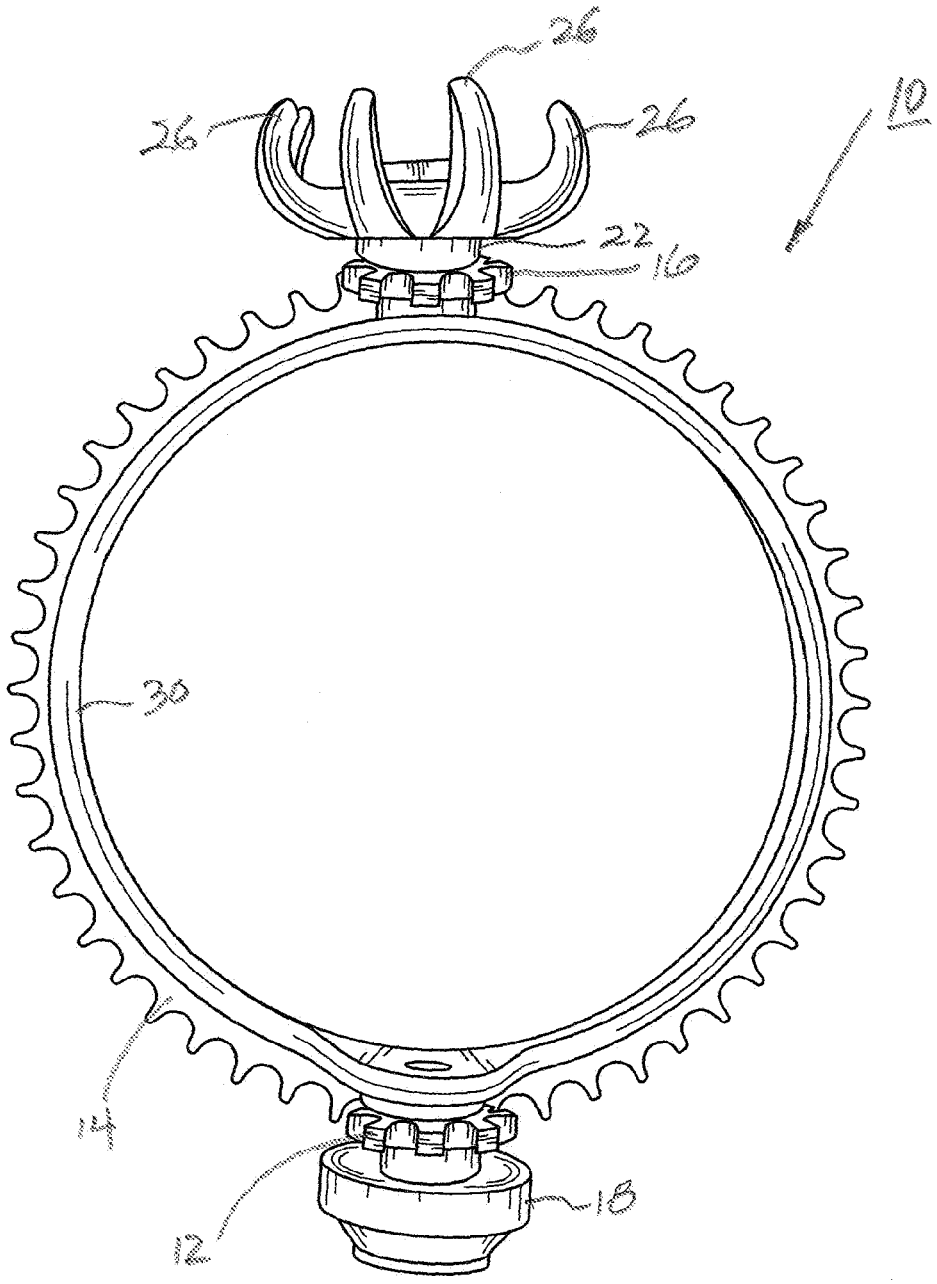
FIG. 2 is a plan view of the mechanism shown in FIG. 1.
Figure 3:
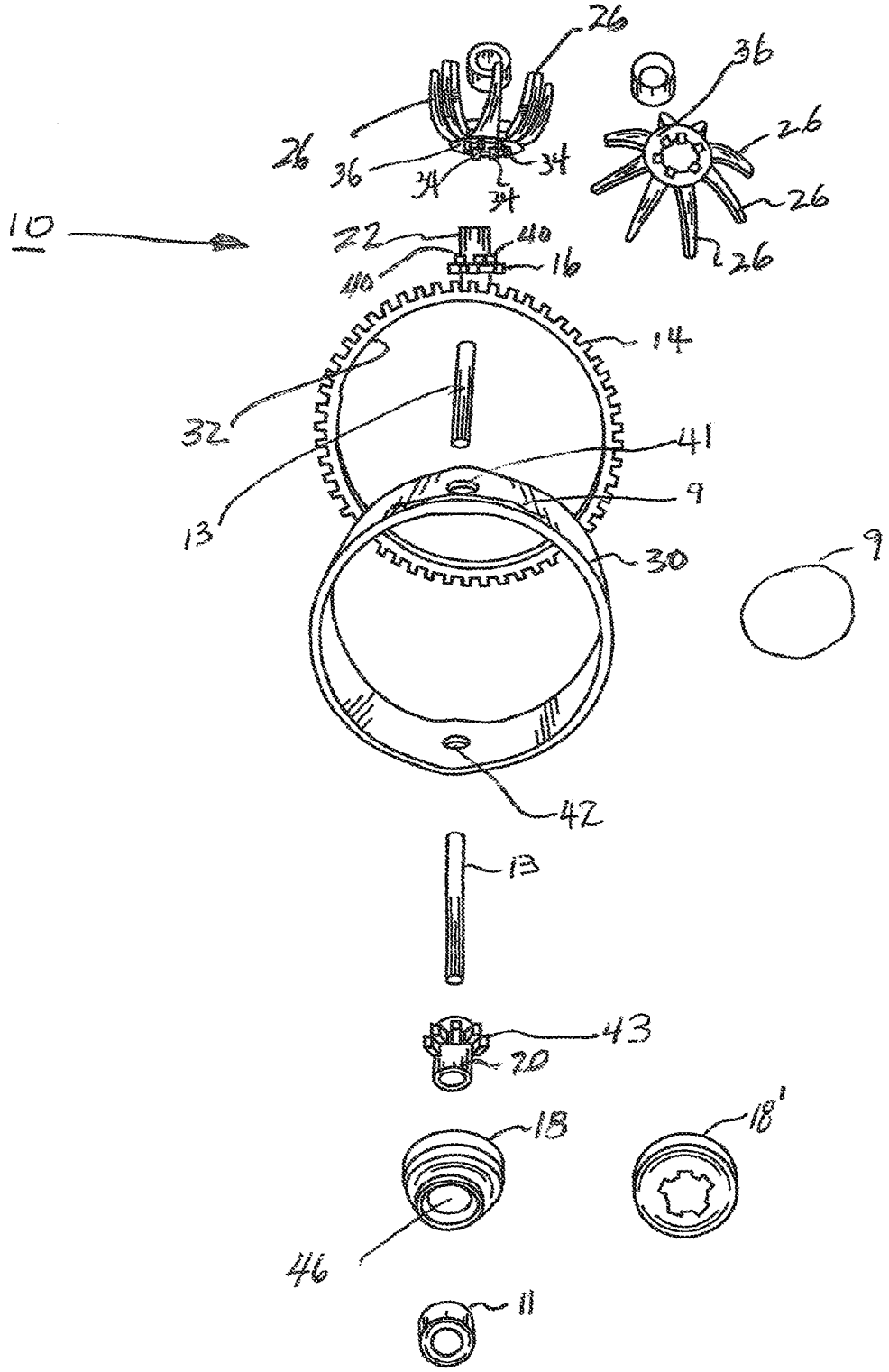
FIG. 3 is an exploded view of the ring rotating mechanism of the present invention.

Referring to FIGS. 1-3, jewelry item 10, such as a ring, comprises a multi-toothed gear 12, circular multi-toothed gear 14 and multi-toothed gear 16 and crown, or stem 18. Crown 18 is arranged so that it is rotatable about pin 20 having recesses 43. The teeth of gear 12 engages the teeth of gear 14 which in turn is positioned to engage the teeth of gear 16. Gear 16 is rotatably mounted onto shaft 22, a setting 24 having multiple prongs 26 formed thereon. A gemstone 28 is secured to jewelry item 10 by prongs 26 in a manner well known in the jewelry industry. A ring member 30 is secured to the internal surface 32 of gear 14 which enables the ring wearer to insert a finger there through.

As shown in FIG. 3, a plurality of protrusions 34 extend from the bottom surface of plate 36 and are adapted to engage corresponding recesses 40 formed on the upper surface of gear 16. Protrusions 34 and recesses 40 have male and female teeth which, when engaged, lock together. Bezel gear 16 extends through the gemstone head holder, the external surface of band 30 supporting a circular wire 9 that extends along circumference of band 30 and is soldered thereto. Band 30 engages circular multi-toothed gear 14, inner surface 32 having a female groove for receiving wire 9, wire 9 extending through gear 14 thus locking gear 14 to internal surface of band 30. Note that the wire 9 shown to the right of ring member 30 is not to scale but, in actuality, is sized to extend complete around the external surface of ring member 30.

The internal surface of band 30 has two holes 41 and 42 for receiving pin 13 therethrough.

As illustrated, a single gear 16 is disposed at the top of ring member 30 and single gear 12 is disposed at the bottom of ring member 30.

Crown 18 (top view shown below shaft 20, a bottom view of crown 18 is shown by reference numeral 18' engages shaft 20 and pin 13 passes through each; crown 18, shaft 20 and pin 13 engage the internal surface of ring 30 and are soldered thereto.

Bezel 11 is positioned within opening 46 of crown 18 and is soldered to shaft 20 and crown 18 to keep the assembly together.

In order to enhance the aesthetic effect resulting from the reflection and sparkling of a stationary gemstone, the ring wearer has the option of rotating crown 18. Specifically, when the ring wearer elects to rotate crown 18, gear 14 is, as a result, rotated. The rotation of gear 16 then rotates shaft 22 which causes gemstone 28 to be rotated, providing the effect noted hereinabove. Thus, rotation of crown 18 causes the essentially simultaneous rotation of gear 14, gear 16, shaft 22 and gemstone 28.

Although not shown, the mounting plate 36 can be designed such that additional settings for receiving additional gemstones are formed thereon. In addition, at least one guard member (not shown) can be positioned to surround gear 14 to enhance the appearance of ring 10.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A jewelry item for a gemstone comprising:

a circular housing member having interior and exterior surfaces, the interior surface defining an opening to receive a finger of a wearer;

a circular gear having multiple teeth mounted about an entire circumference of said exterior surface of said circular housing member;

a rotatable stem positioned at the bottom of said circular housing member and rotatable about a vertical axis;

a first multiple tooth gear coupled to said rotatable stem;

a rotatable gemstone mounting device having first and second surfaces;

a second rotatable multiple-tooth gear mounted to the second surface of said mounting device; and a member positioned on the first surface of said mounting device for securing the gemstone to said jewelry item.

2. The jewelry item of claim 1 wherein the teeth on said circular gear interact with both said first multiple tooth gear and said second multiple tooth gear.

3. The jewelry item of claim 2 wherein said stem is adapted to be rotated by said wearer in a first direction about said vertical axis, which causes said mounting device to rotate in said first direction.

4. The jewelry item of claim 3 wherein said stem is adapted to be rotated by said wearer in a second direction about said vertical axis, which causes said mounting device to rotate in said second direction.

5. The jewelry item of claim 4 wherein said stem is rotatable 360 degrees about said vertical axis.

* * * * *